United States Patent [19]

Berger

[11] 4,068,817

[45] Jan. 17, 1978

[54] SUSPENSION HANGER

[76] Inventor: Sol J. Berger, 310 Melvin Drive, Northbrook, Ill. 60062

[21] Appl. No.: 755,467

[22] Filed: Dec. 29, 1976

[51] Int. Cl.[2] ..... B42F 13/00

[52] U.S. Cl. ..... 248/340; 40/613; 248/303; 248/327

[58] Field of Search ..... 248/339, 340, 341, 359, 248/360, 303, 304, 327, 320, 322, 330; 211/113, 117; 40/128, 138

[56] References Cited

U.S. PATENT DOCUMENTS

| | | | |
|---|---|---|---|
| 1,434,532 | 11/1922 | Davala et al. | 248/340 |
| 2,021,506 | 11/1935 | Hamilton | 267/178 |
| 3,531,069 | 9/1970 | Dubberley | 248/358 AA |
| 3,961,711 | 6/1976 | Perks | 248/322 |

FOREIGN PATENT DOCUMENTS

| | | | |
|---|---|---|---|
| 486,330 | 11/1929 | Germany | 40/138 |
| 584,498 | 1/1947 | United Kingdom | 248/358 AA |

*Primary Examiner*—Robert A. Hafer
*Attorney, Agent, or Firm*—Morris Spector

[57] ABSTRACT

A suspension hanger suspending a light weight point of purchase display in a manner that will permit swinging and turning of the display by slight air currents that are normally present in the surrounding atmosphere, and which will permit simple lowering of the display in the initial installation, or thereafter, to bring it to its desired height. The suspension consists of a vertical helical spring by which the display is suspended to permit oscillation of the display about a vertical axis, the spring being of a small diameter to permit swinging of the display, and being of a material of a low modulus of elasticity so that upon the exertion of a comparatively small pulling force in excess of the weight of the display the spring is stretched beyond its elastic.

10 Claims, 5 Drawing Figures

SUSPENSION HANGER

OBJECTS

This invention relates to the suspension of a light weight advertising display, such as for instance a point a purchase display of the type that are suspended as by a thin string or cord to be capable of rotary and also oscillating movement by the action of even slight air currents, such as are caused by opening and closing of doors, ventilators, etc., movement of persons, or even by the gravitational air flow produced by nearby lights and refrigerating equipment. Such displays are generally mounted at a desired height above the floor. In mounting them, when it is found on the first trial the display is too high it is necessary to increase the length of the suspending cord. This is a time-consuming operation. It is an object of this invention to provide a display or the like with a suspension which will permit the above mentioned desired oscillating and rotary movement and whose length may be easily increased by merely pulling the display downwardly to permanently lengthen the cord the desired amount.

The suspension cord of the present invention is a helical spring of a small diameter (in one instance 0.125 inches) made of thin metal wire (in one instance 0.0075 inches diameter) of a material which has a low modulus of elasticity so that by the application of a small pull (but more than the weight of the display) it is stretched beyond its elastic limit and upon release of the pull the spring has been permanently elongated an amount which is a function of the distance of the pull. One end of the spring is adapted to receive the advertising display that is to be suspended and the other end is adapted to hook into or on a support from which the spring is to be suspended.

A helical spring of the above mentioned type is generally much more resistant to rotary twisting than in a cotton string as is commonly used for displays of this type, and therefore the display suspended therefrom might not be sufficiently activated by slight air currents to produce the desired rotary motion. To overcome this diffficulty a swivel is interposed between either the display and the spring or between the spring and its support.

DRAWINGS

DESCRIPTION

Figure 1:
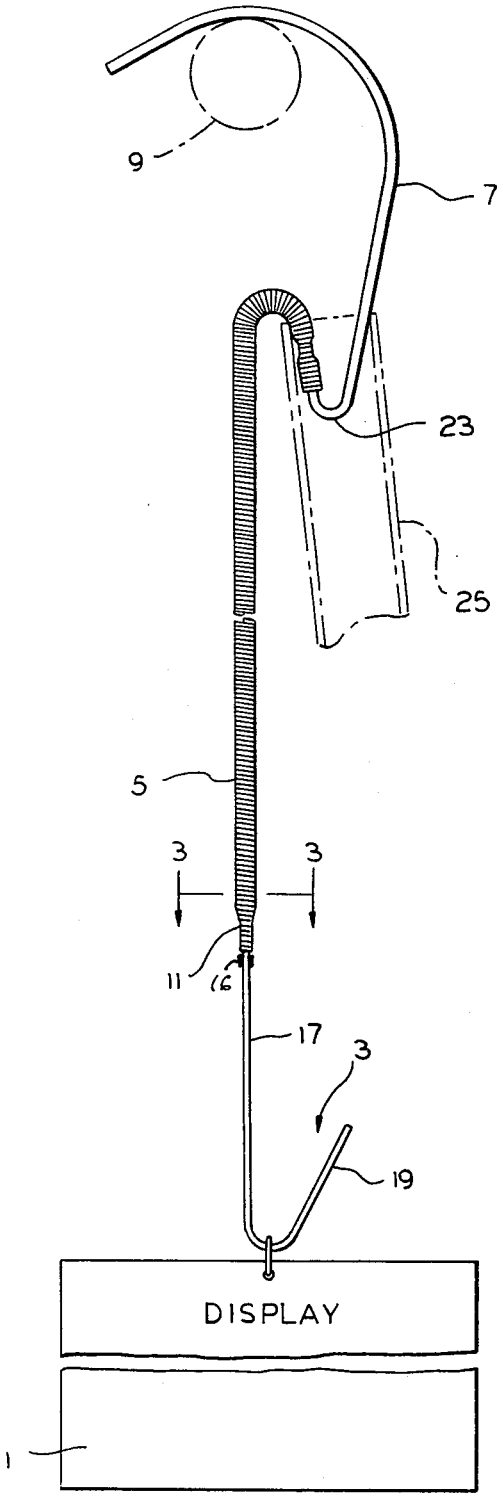
FIG. 1 is a side view of a display embodying the present invention.
Figure 2:
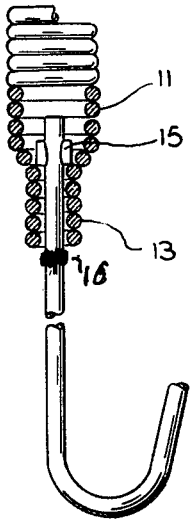
FIG. 2 is an enlargement, partially in section, illustrating the lower end of the spring partially broken away and the supporting hook.
Figure 3:
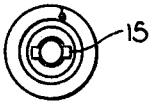
FIG. 3 is a section taken along the line 3—3 of FIG. 1.
Figure 4:
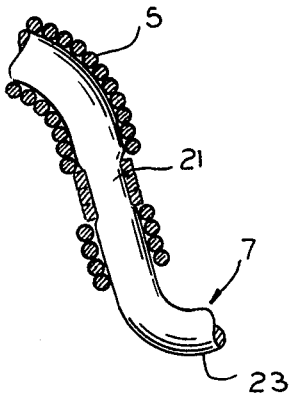
FIG. 4 is an enlarged cross-section of the juncture between the upper end of the spring and the mounting hook.

Reference may now be had more particularly to the drawings wherein like reference numerals designate like parts throughout.

FIG. 1 shows a preferred embodiment of the present invention. A conventional advertising display is shown at 1. It may comprise a banner, a poster, a picture, a mass of light-reflecting tinsel or the like, or any other material that is to be suspended overhead in a store, for instance a supermarket, for attracting the attention of the customers. It is light in weight and intended to be swayed or turned by air currents normally present in region of the display. The display is suspended from a wire hook 3 that is swivelled in one end of a helical spring 5 that has another wire hook 7 secured thereto at its opposite end. Either one of the hooks may be used for suspending the spring as from a pipe or other building support 9, and the other hook used to receive the display 1.

The spring 7 is a helically coiled spring of wire 11 of elastic material, preferrably a metal alloy, of sufficient strength to sustain the small weight of the display and of a small modulus of elasticity so an axial pull on the coiled spring of a comparatively small force, but greatly in excess of the intended weight of the display 1 will stretch the spring beyond its elastic limit to permanently lengthen it any desired amount within a broad range. In one instance the spring 5 was of a diameter of 0.125 inches, or wire of a diameter of 0.016 inches and could be stretched beyond its elastic limits from 3 to 15 times its original length.

At its lower end the turns of the spring 8 are of a reduced diameter to provide a short sleeve 11. The inside diameter of this sleeve is slightly less than the diameter of the wire 17 that constitutes the hook 3. The wire 17 is flattened or swaged at one end to form a wing 15 of a width greater than the inside diameter of the sleeve 13 and less than the inside diameter of the spring 5. When the wire 17 is still a straight wire, that is before it has been bent at its lower end 19, it is inserted into the bore of the spring 5 from the upper end of the straight spring, and is moved axially thru the spring until it extends thru the sleeve and the head 15 comes to rest within the bore of the spring and on the top of the sleeve 13. In that position it can still rotate freely axially, but cannot be further retracted. The position of the wire 17 immediately below the sleeve 11 is then swaged to form an enlarged wing 16 to prevent return of the wire into the coiled spring. Just before the spring 3 is to be assembled with the display 1 the wire 17 is bent to form the hook 19.

Thereafter the pre-shaped wire hook 7 is inserted into the opposite end of the spring, that hook being of a diameter only slightly less (or the same as) the inside diameter of the spring 5. The end of that wire makes a snug fit inside the helical coil of the spring. The end of the hook 7 is then made fast to the spring by a flattening swagging blow that permanently deforms the wire of the hook 7 and of the spring as indicated at 21, thus securig the spring against retraction from the hook 7.

The hook 7 has a reverse bend 23 at its lower end. This permits seating of the hook, at the bend 23, in a long lifting tube 25, of cardboard or of metal, for lifting the hook 7 and its spring 5 and display 1 into position over a support 9.

Figure 5:
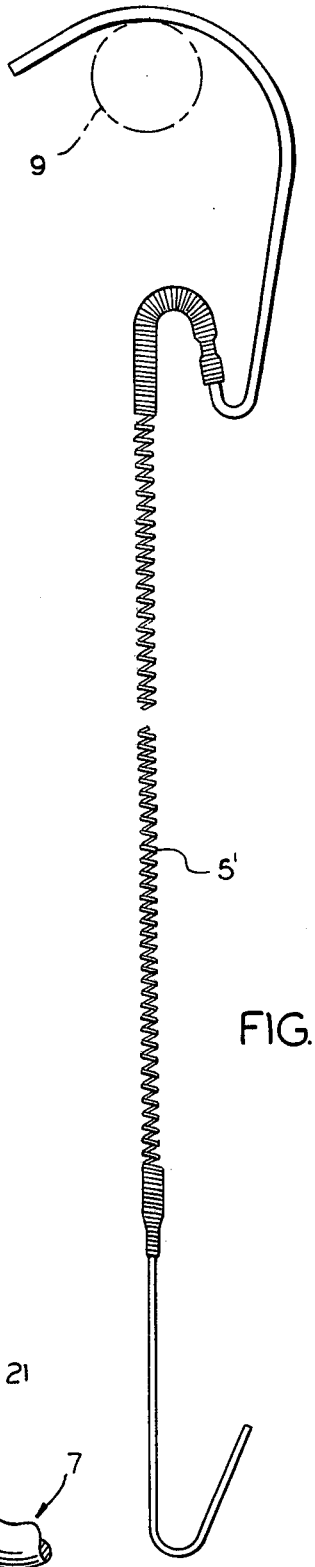
FIG. 5 is an illustration of the stretched spring.

The spring 5, in its initial condition, has a minimium pitch so that successive coils of the helix are in contact with one another. It can be stretched, within its elastic limits, a small amount. If stretched beyond that small amount, the elastic limit is exceeded and the spring is permanently elongated. The force required to stretch it beyond its elastic limit is a small amount in excess of the weight of the display. A spring of an initial length of 6 inches can be stretched in excess of 30 inches beyond its elastic limit by merely pulling down on the display. The spring is then elongated to a permanent length as desired. This is illustrated in FIG. 5 wherein the initial 6 inch length of spring was stretched 30 inches beyond its elastic limit. Due to its small diameter the spring acts as a suspension cord for suspending the display. The twisting characteristics of the spring itself are less than the twisting characteristics of a thin suspension cord, but this difference is compensated for by the swivel connection between the hook 3 and the spring.

In compliance with the requirements of the patent statutes I have here shown a preferred embodiment of the present invention.

What is claimed as new is:

1. A variable height free swinging suspension display unit of the type to be set in free-swinging motion by ambient air currents, said unit comprising a display piece and a slender cord-like helically coiled spring having means at one end for suspending the unit from a support and at its other end means for suspending the display piece from the spring for free swinging movement of the suspended display piece, characterized by the fact that the spring has a modulus of elascticity small enough to permit it to be stretched beyond its elastic limit by exerting on the suspended display piece a pulling force which is a small amount in excess of the weight of the display piece to permanently lengthen the spring end thus lower the level at which the display piece is suspended by the spring.

2. A unit according to claim 10 wherein the means for suspending the unit comprises a wire one end of which is connected to the spring and the other end of which has means for hanging it from a support and between the two last mentioned ends it has a reverse bend for releasably supporting it on the end of an elevating pole whereby it may be elevated for hooking it on a support.

3. A unit according to claim 10 wherein the pitch of the spring helix is substantially equal to the thickness of the spring winding material, and the inside diameter of the helix is less than 10 times that thickness.

4. A unit according to claim 2 wherein the pitch of the spring helix is substantially equal to the thickness of the spring winding material, and the inside diameter of the helix is less than 10 times that thickness.

5. A unit according to claim 10 wherein the characteristics of the spring permit stretching of the spring to an elongation of the order of at least four times the original spring length while retaining spring characteristics but which reaches its elastic limit before the spring has been stretched to double its length.

6. A unit according to claim 3 wherein the characteristics of the spring permit stretching of the spring to an elongation of the order of at least four times the original spring length while retaining spring characteristics but which reaches its elastic limit before the spring has been stretched to double its length.

7. A unit according to claim 4 wherein the characteristics of the spring permit stretching of the spring to an elongation of the order of at least four times the original spring length while retaining spring characteristics but which reaches its elastic limit before the spring has been stretched to double its length.

8. A unit according to claim 10 wherein the portion of the suspension wire has a hook-shaped bend at the end thereof outside of the helical spring, and the display piece is suspended from said hook-shaped bend of that wire.

9. A unit according to claim 1 wherein one of the two last named means includes a swivel connection permitting free turning of the portion of the unit below the connection with respect to the portion of the unit above the connection about the longitudinal axis of the spring.

10. A unit according to claim 5 wherein one of the two last named means includes a swivel connection permitting free turning of the portion of the unit below the connection with respect to the portion of the unit above the connection about the longitudinal axis of the spring.

* * * * *

UNITED STATES PATENT OFFICE

CERTIFICATE OF CORRECTION

Patent No. 4,068,817 Dated January 17, 1978

Inventor(s) Sol J. Berger

It is certified that error appears in the above-identified patent and that said Letters Patent are hereby corrected as shown below:

In line 1, of claims 2,3,5 and 8 "claim 10" should read -- claim 1 -- in each instance.

Signed and Sealed this

Sixth Day of January 1981

[SEAL]

Attest:

SIDNEY A. DIAMOND

Attesting Officer

Commissioner of Patents and Trademarks